United States Patent [19]

Hayes et al.

[11] Patent Number: 4,810,208

[45] Date of Patent: Mar. 7, 1989

[54] PROBEABLE SEALED CONNECTOR

[75] Inventors: Earl J. Hayes, Advance; Allen F. VanDerStuyf, Kernersville, both of N.C.

[73] Assignee: AMP Incorporated, Harrisburg, Pa.

[21] Appl. No.: 53,218

[22] Filed: May 22, 1987

[51] Int. Cl.[4] ..... H01R 13/40

[52] U.S. Cl. ..... 439/589; 439/281

[58] Field of Search ..... 439/281, 282, 482, 588, 439/589, 592, 594, 595, 598, 599; 324/508, 538, 73 R, 73 PC, 158 F, 158 D

[56] References Cited

U.S. PATENT DOCUMENTS

| | | | |
|---|---|---|---|
| 3,327,282 | 6/1967 | Krolak | 339/63 |
| 3,731,257 | 5/1973 | Bakker | 339/66 M |
| 3,787,796 | 1/1974 | Barr | 339/60 VB |
| 3,937,545 | 2/1976 | Cairns et al. | 339/60 R |
| 4,090,759 | 5/1978 | Herrmann, Jr. | 430/281 |
| 4,168,875 | 9/1979 | Leonard, Jr. et al. | 339/147 R |
| 4,225,206 | 9/1980 | Roman, Jr. | 339/91 R |
| 4,241,971 | 12/1980 | Leonard, Jr. et al. | 339/116 C |
| 4,311,355 | 1/1982 | Plyler et al. | 339/94 R |
| 4,513,356 | 4/1985 | Mikola | 339/186 R |
| 4,531,796 | 7/1985 | Gansert et al. | 439/589 |
| 4,614,390 | 9/1986 | Baker | 339/61 R |
| 4,640,567 | 2/1987 | Lundergan et al. | 339/94 M |
| 4,643,506 | 2/1987 | Kobler | 339/94 M |
| 4,768,970 | 9/1988 | Nestor | 439/281 |

FOREIGN PATENT DOCUMENTS

| | | |
|---|---|---|
| 0072104 | 2/1983 | European Pat. Off. . |
| 968707 | 9/1964 | United Kingdom . |
| 1434665 | 5/1976 | United Kingdom . |
| 2077055 | 12/1981 | United Kingdom . |
| 2013047B | 9/1982 | United Kingdom . |

OTHER PUBLICATIONS

"AMP* Econoseal Connectors", AMP Incorporated Instruction Sheet IS 7900 (Released 2-24-78).

"Metri-Pack" GM Publication (6-83) pp. A-24 and A-97.

*Primary Examiner*—Paula A. Austin

*Attorney, Agent, or Firm*—Eric J. Groen

[57] ABSTRACT

An electrical connector includes an insulative housing having a front mating face and a rear sealed face. The connector housing further includes a plurality of terminals disposed in apertures which extend between the front face and the rear sealing face of the housing. The terminals include front contacting portions adjacent to the front face and wire connecting portions adjacent to the rear face. The terminal also includes an integral portion which extends beyond the rear sealing face. A seal is provided at the rear sealing face which is retractable therefrom to expose the extending terminal portions for probing. The seal is retractable from the rear sealing face while the electrical connector is connected to a matable receptacle, and while the system, to which the electrical connector and receptacle are connected, is operating.

22 Claims, 10 Drawing Sheets

PROBEABLE SEALED CONNECTOR

BACKGROUND OF THE INVENTION

1. Field of the Invention

The instant invention relates to a sealed diagnostic electrical connector having a retractable seal which retracts to a position to at least partially expose the electrical terminals for probing. The electrical terminals can be probed while the electrical connector is connected to a mating connector, and while the system, to which the connector is applied, is operating.

2. Description of the Prior Art

Electrical connectors are often times used outside or otherwise in environments which cause corrosion and the like, which eventually causes discontinuity between at least some of the electrical connections, thus connectors of this type should be sealed, protecting the electrical connection from the hazardous environments and resultant corrosion. Often times when a system becomes inoperable, a possible checkpoint is the electrical connection between the mating electrical connections. However to check the electrical connection, the mating electrical connectors must be disengaged, which could temporarily remedy the situation, as the wiping action between the electrical components during disengagement, could clean the mating electrical components sufficiently enough to temporarily recreate an electrical circuit.

Thus it is desireable to have an electrical connector which is sealed, preventing any stages of corrosion and resultant discontinuity between the electrical mating components. It is also desireable for the electrical connector to include a means of probing the connector, if the system, which is interconnected by the electrical connector, becomes inoperale, without having to disconnect the mating electrical connectors.

One method of testing a faulty electrical circuit, presently utilized within the art, is shown in U.S. Pat. No. 3,718,859. This test element is actually a mating connector which is interconnected between the mating electrical connectors. However to utilize such a test element, the mating connectors to which the system is interconnected, must be disconnected, and the test element inserted between the two disconnected mating electrical connectors. If the connection between the mating connectors is faulty, the wiping action on the mating electrical terminals caused by disconnecting the mating connectors may be sufficient to complete the electrical connection between each of the disconnected electrical connectors and between the respective portion of reconnected test element. It may also be possible that an electrical connection can be made between the test element and the electrical connectors, but when the electrical test element is removed and the electrical connectors replaced, the electrical connectors still do not mate properly, or contact each other properly to create an unimpeded electrical connection.

Other methods of testing inoperable systems include disconnecting the mating connectors which interconnect the system, and testing each half of the system which is disconnected. However, some systems fail to function properly only under certain operating conditions of the system, and therefore to test such a system, the system must be operational while the test is made. If the interconnection between the mating connectors is broken to make the test, the system, is per se inoperable under its normal operating conditions.

SUMMARY OF THE INVENTION

It is therefore an object of the instant invention to provide for an electrical connector which is sealed to prevent exposing the electrical components to contaminants of the environment in which they operate, rendering the electrical connection inoperable.

It is a further object of the invention to provide for a means to probe the electrical connection between intermating electrical terminals to determine whether they are functioning properly.

It is a further object of the invention to provide for an electrical connector which can be probed to test for malfunctions within the system while under operating conditions of the system.

The above-mentioned objectives were accomplished by designing an electrical connector which includes an insulative body with at least one electrical terminal mounted within an aperture of the body. The terminal includes contacting means for interconnection to a mating connector, means to interconnect the conductor of an insulated conductor to the terminal, and further includes a portion which is disposed adjacent to a probe access port. A seal is disposed around the insulated conductors and the probe access port, thereby sealing the terminals from the exterior environment. The seal is movable away from the port to access the portion of the terminals adjacent to the port with a probe.

In the preferred embodiment of the instant invention, the insulative body includes a front mating face with apertures therethrough for receiving pins of a mating connector, to which will interconnect with the contacting portions of the terminals within the connector. The insulative body further includes a rear face which receives the terminals and which serves as the probe access port, the seal covering the face while in the sealed position and retracting away from the rear face, to expose portions of the terminals, when in a probing position.

The preferred embodiment of the invention includes a plurality of terminals which include wire crimp portions for terminating conductors of insulated wires thereto, and extended contact portions integral with the terminals which extend rearwardly of, and beyond the rear face of the insulative body. When the seal is retracted from the rear face of the insulative body, the extended portions of the contacts are exposed for access of the terminals for probing, and as the seal is retracted from the rear face of the housing, the terminal contacting portions at the front mating face are undisturbed and therefore do not need to be disconnected. The preferred embodiment of the invention further includes a sealing cap partially surrounding the sealing member which provides for a rigid assembly in which to handle. Other features and advantages of the preferred embodiment are disclosed herein and are shown in the several drawings which follow.

BRIEF DESCRIPTION OF THE DRAWINGS

FIG. 3 is an isometric view of the terminal of the electrical connector.

FIG. 5 is similar to the cross-sectional view of FIG. 2 showing the connector components in an assembled condition and electrically interconnected with a matable electrical receptacle.

DETAILED DESCRIPTION OF THE PREFERRED EMBODIMENT

Figure 1:
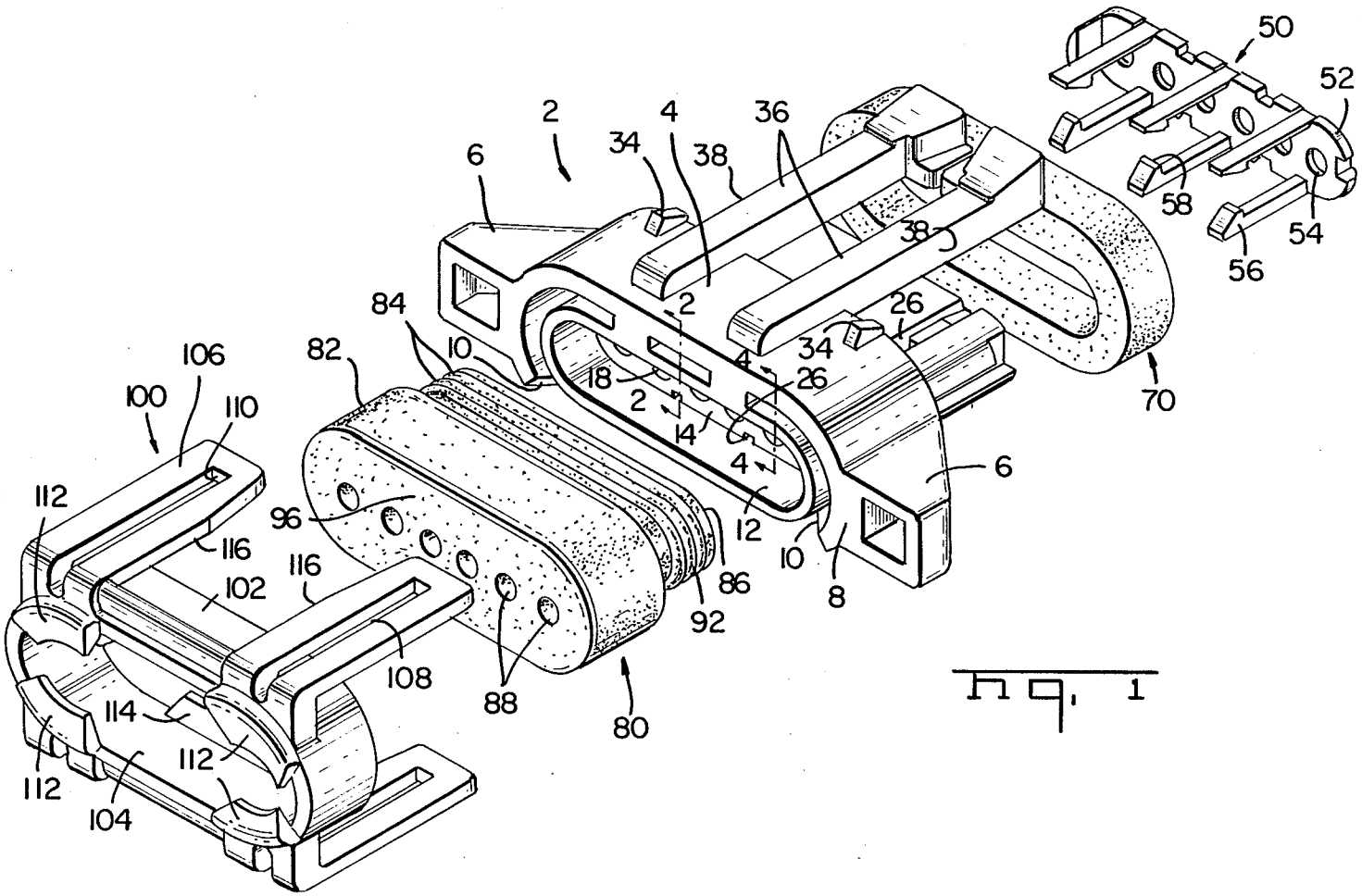
FIG. 1 is an isometric view of the electrical connector of the instant invention showing the connector components exploded away from the connector body.

With reference first to FIG. 1, the electrical connector of the instant invention generally includes a housing 2 having an interfacial seal member 70 disposed at a front face thereof and an end cap 50 which provides a location and retention feature for electrical terminals (not shown) which will be positioned within apertures of the housing 2. The electrical connector further includes a retractable seal member 80 and a sealing cap 100.

With reference still to FIG. 1, the connector housing 2 includes an insulative body portion 4 having gripping members 6 flanked on either side of the housing 2. An internal cavity is defined by an inner peripheral surface 12 and a rear wall 14, the peripheral surface extending from a face 8 to the rear wall 14. The rear wall 14 includes a plurality of apertures 18 extending therethrough for receipt of a like plurality of electrical terminals which will be described in greater detail later. A plurality of channels 26 also extend forwardly from the rear wall 18 and are defined by the retracting mold dies, which too will be described in greater detail later. The insulative housing 2 further includes two latching arms 36 extending forwardly therefrom, two latching protrusions 34 are included on the upper surface of the housing 2 and two latching protrusions 34 (not shown in FIG. 1) are located on the lower side of the housing member 2, symmetrically located as the upper latching protrusions 34.

Figure 2:
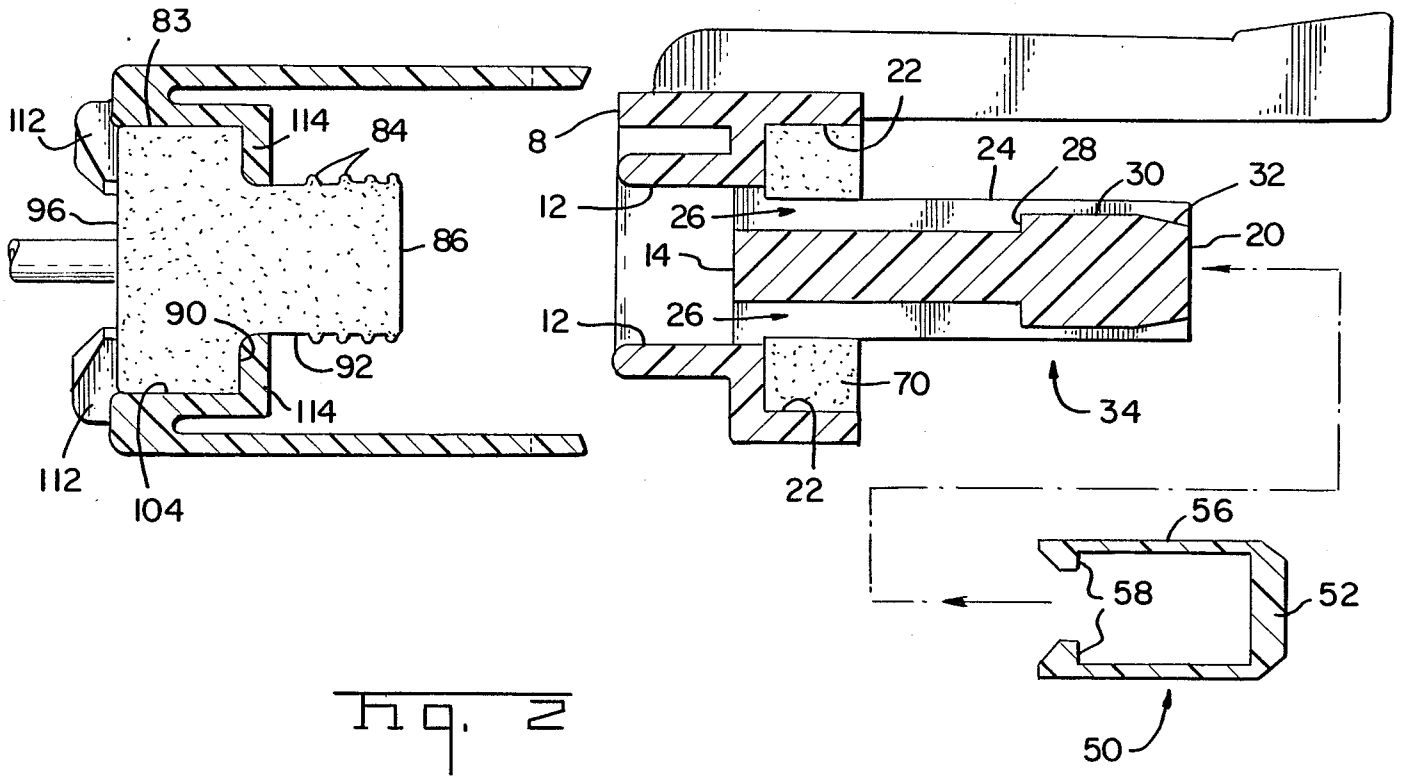
FIG. 2 is a cross-sectional view through lines 2—2 of FIG. 1.

With reference now to FIG. 2, the connector housing 2 will be described in greater detail. FIG. 2 is a cross-sectional view through the insulative housing 2 at a position where the channels 26 pass. Channels 26 are defined when the mold dies are retracted to form the latching surfaces 28. The channel 26 continues to the end of 20 the nose portion 34 defining a stepped surface 30 and a ramped surface 32. It should be understood that the ramped surface 32 would be formed by a retracting mold die which retracts from the front of the housing 2 in an opposite direction as the retracting dies which form the channels 26. The forward nose portion 34 includes an outside and peripheral surface 24 surrounding the nose portion.

Referring again to FIG. 1 shows that the end cap 50 includes a latching plate 52 with a plurality of latching arms 56 extending forwardly therefrom. The latching plate also includes a plurality of apertures 54 through the plate, each aperture being in alignment with one of the apertures 18 through the housing 2. FIG. 2 shows the cross-sectional view through the aperture 26 of the housing and through the end cap 50 at a position where a latching arm 56 extends. It should be noted that the thickness of the latching arms 56 is equal to or less than the distance between surfaces 24 and 30 of the nose portion; therefore, when the end cap is placed over the nose portion, the latching arms reside in the channels 26 and the upper surface generally defined by 24 is unobstructed by the upper surface of the latching arms 56. The nose portion 34 of the connector housing, including the end cap 50, can therefore be later inserted into a receptacle assembly without obstruction from the latching arms. It should also be noted that when the end cap 50 is inserted over the nose portion 34 of the housing, the latching surfaces 58 are securely fastened behind the surface 28 within the channel 26 of the housing.

With reference still to FIG. 2, the cavity formed forwardly of the rear face 8 and defined by peripheral surface 12 and end wall 14 is shown in greater detail. Also shown in better detail in FIG. 2 is the cavity 22 which houses the interfacial seal 70. It should be understood that the cavity 22 extends in an oval shaped configuration around the housing 2 and, of course, is shaped so as to receive the interfacial seal shown in FIG. 1.

Figure 4:
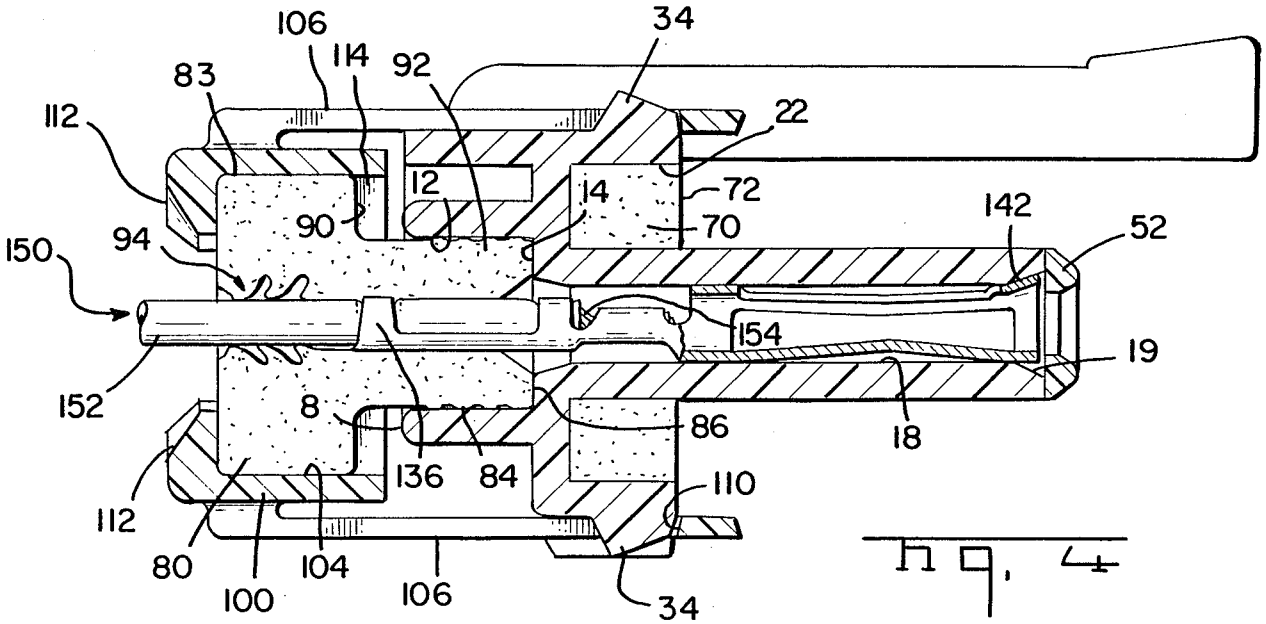
FIG. 4 is a cross-sectional view through lines 4—4 of FIG. 1 with the connector components assembled.
Figure 7:
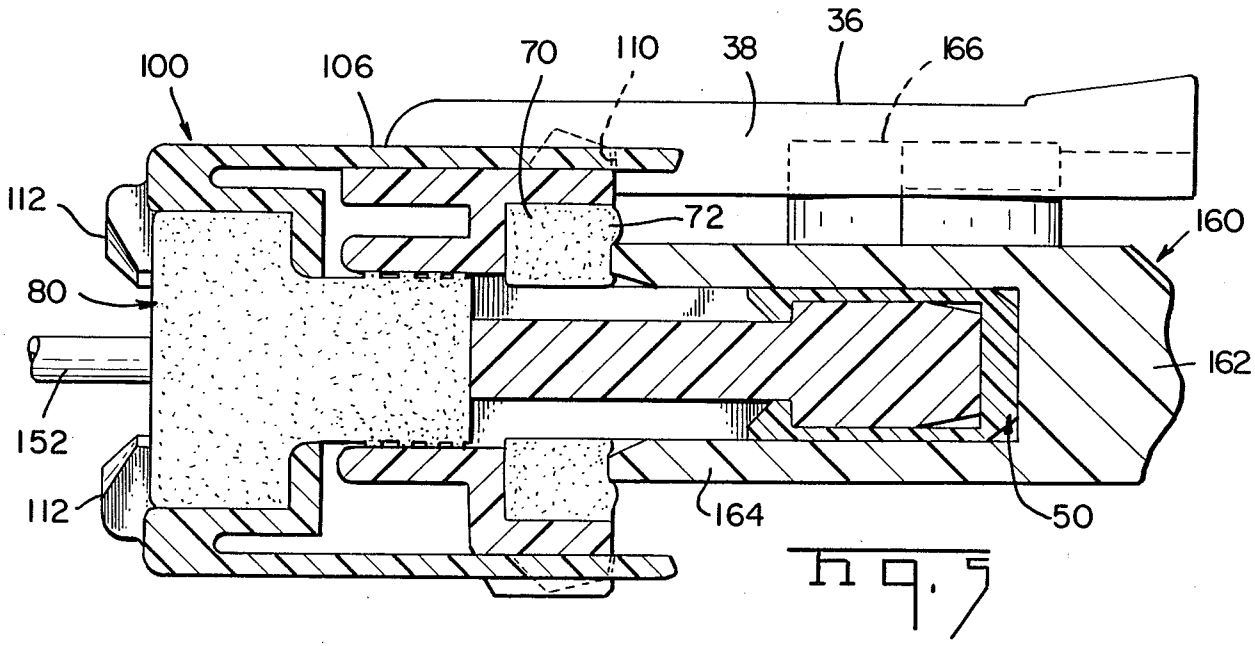
Figure 6:
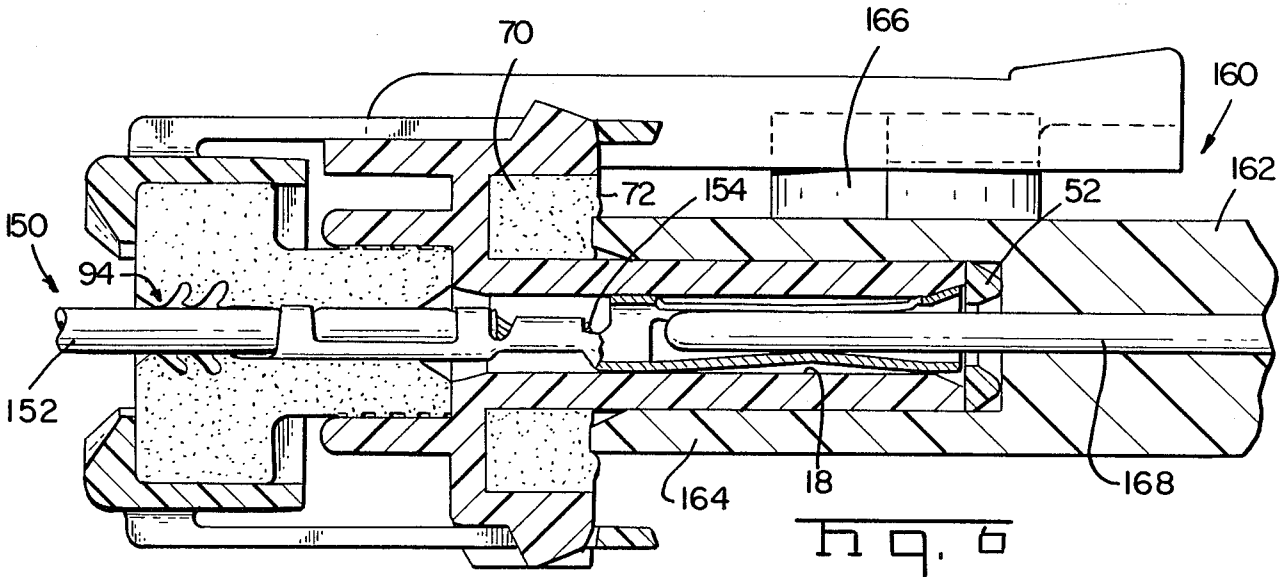
FIG. 6 is a cross-sectional view similar to that of FIG. 4 showing the connector mated with the electrical receptacle.
Figure 7:
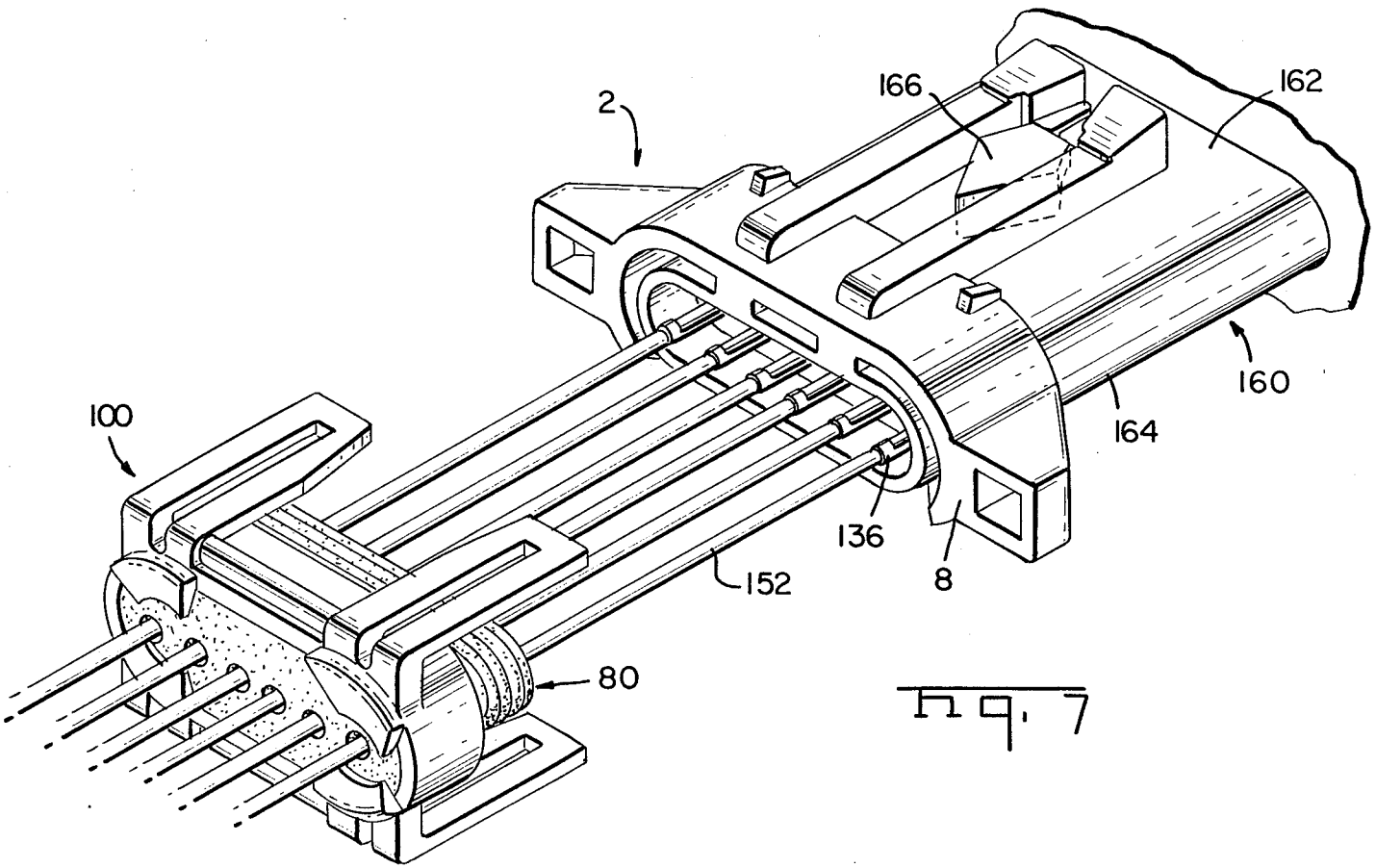

Referring again to FIG. 1 shows the retractable seal 80 and the seal cap 100 in greater detail. The seal 80 generally comprises a body portion 82 with a protruding portion 92 extending forwardly therefrom, the protruding portion 92 including a plurality of peripherally extending ribs 84 in a surrounding relationship. The seal member 80 further includes a plurality of apertures 88 extending between a rear surface 96 and a forward surface 86, the apertures being spaced and profiled for alignment with the plurality of apertures 18 within the insulative body 4 and with the apertures 54 in the end cap 50. As best shown in FIGS. 4 and 6, the interior portions of the apertures includes sealing ribs 94 which are profiled for sealingly surrounding an insulated conductor which extends through the seal member 80.

As shown in FIG. 1, the end cap 100 generally comprises a body portion 102 which includes an inner cavity defined by the inner peripheral surface 104, the surface 104 being oval shaped to surround the body portion 82 of the seal member 80. The body portion 102 of the cap 100 further includes four latching arms 106 extending from the sealing body 102, the latching arms including slots 108 which define latching surfaces 110. The end cap 100 also includes outer retaining fingers 112 and inner retaining fingers 114 which are integrally molded with the end cap 100. It should be noted that each inner retention finger 114, although axially spaced from, is conveniently positioned between two outer retention fingers 112 so as to allow a single draw molding technique in the molding of the seal cap 100.

The electrical connector further comprises a plurality of electrical terminals 130, as shown in FIG. 3, and generally includes a wire connecting portion at one end and a contacting portion at the opposite end. The wire connecting portion includes a crimp portion 132, a strain relief portion 134, and an extended probing portion 136. At its opposite end, the contacting portion of the terminal comprises a cylindrical band portion 138, and a forward band portion 140 with a plurality of resilient beam sections 144 extending therebetween. Each of the beam sections 144 bows inwardly, at 146, to form a constricted section to bias against a pin when inserted. The forward band portion 140 further includes outwardly formed retention portions 142 at the forward end thereof.

In FIG. 2, the seal member 80 is shown as being inserted into the seal cap 100 such that the rear surface 96 and the forward surface 90 of the seal member 80 are trapped between the rear 112 and forward 114 retention fingers of the seal cap 100. The peripheral surface 83 of the seal member 80 is also tightly retained within the internal surface 104 of the seal cap, which slightly compresses the seal, and gives the seal body 82 some rigidity, allowing the seal member 80 to be more easily handled.

To assemble the connector, an unprepared end of an insulated conductor is inserted through the aperture 88 of the seal member 80 and through the respective aperture 18 of the insulative body 4 until the end projects past the front face 20 of the insulative body 4. The end of the insulated conductor is then stripped and the prepared end is placed within the crimp portion 132 of the terminal 130. The terminal portion 132 is crimped around the conductor and the strain relief member 134 and the extended probing portion 136 are wrapped around the insulation of the insulated conductor. The terminal, as shown in FIG. 3, is commonly referred to as a pull to seat contact and with the terminal and conductor assembled as described above, the insulated conductor which extends from the insulative body 4 can be pulled to seat the terminal within its aperture 18. The retention portions 142 on the forward end of the band portion 140 abut the frustoconical surface 19 at the forward end of the aperture 18, and thereby retain the terminal from rearward movement within the aperture 18, as shown in FIG. 4. The installation of the terminals 130 is then continued in the above described manner until all of the terminals are inserted within the apertures 18 of the insulative housing. With all terminals pulled rearwardly and seated within their respective apertures 18, the end cap 50 can be placed over the forward nose portion of the connector and each latch member 56 is aligned with a respective channel 26 in the nose portion, the latching members riding up over the camming surface 32 until the latching surface 58 of the end cap 50 is latched behind the shoulder 28 within the channel 26, as best shown in FIGS. 2 and 5. The forward edge of the terminal band portions 140 abut the plate 52 of the end cap 50, restraining the terminals from axial movement within their respective apertures and with respect to the insulative housing. The end cap further provides a visual means to inspect that the terminals are properly positioned within the connector. If the terminals are not properly pulled to seat, the end cap will not properly fit over the end of the nose 34 and become properly latched with the latch surfaces 28. Thus, the latching arms will be projected away from the surface 24 of the nose portion 34, and will not be flush with surface 24. If the terminals are not properly seated and for some reason this is not visually detected, the forward nose will not properly mate with the electrical receptacle, as shown in FIG. 5.

With the terminals installed as described above, the seal member 80 including the seal cap 100 can then be slid forward to seal the internal portions of the electrical connector. Conveniently, and as shown in FIG. 1, the inside edges 116 of the latch arms 106 are profiled to closely fit between the outside edges 38 of the latching arms 36, which aligns the seal forward portion 92 with the cavity of the housing. The edges 116 of the latching arms 106 begin to meet the edges 38 of the latch arms 36 prior to the forward surface 86 of the seal reaching the cavity, assuring proper alignment of the seal portion 92 with the cavity prior to the insertion thereof, thereby preventing any possible damage to the sealing ribs 84.

As shown in FIG. 4, when the forward portion 92 of the seal 80 is inserted within the cavity, the peripheral ribs 84 are deformed against the internal peripheral surface 12 of the insulative body 4 and the forward surface 86 of the seal member 80 is in an abutting relation with the rear wall 14 of the insulative body 4. As best shown in FIGS. 1 and 4, the seal is retained in its forward position by latching arms 106 latching to the extensions 34 on the upper and lower surfaces of the insulative housing. Furthermore, the ribs 94 located within the apertures 88 of the seal member 80 are deformed around the insulation 152 of the insulated conductor 150. It should be noted that the seal 80 has two different axial sealing locations; a first between the sealing ribs 84 and inner peripheral surface 12, and a second between the sealing ribs 94 within the apertures 88 and the insulation of the insulated conductors 150. It should also be noted that the seal between the ribs 94 and the insulated conductors 150 is rearward of the extended portion 136 which allows retraction of the seal without the sealing ribs 94 having to slide over the portion 136 possibly damaging the ribs 94. This also allows the extended portions 136 to be beyond the connector face 8 and accessible for probing, while still allowing the extended portion 136 to be sealed at a position beyond the rear face 8.

With the seal and connector assembled as described above, the connector is matable with an electrical receptacle having a plurality of pins equal in number to the number of terminals within the connector 2. As shown in FIGS. 5 and 6, the connector is matable with a header 160 which includes an insulative body 162 and a plurality of pins 168 equal in number with the plurality of terminals 130 within the connector. Each of the pins 168 protrude through the apertures 54 in the end cap 50 and reside within the apertures 18 in a contacting relation with the constricted portions 146 of the resilient beams 144 of the terminal. The header 160 includes a shroud portion 160 which extends peripherally so as to surround the nose portion of the connector and is profiled to interfere with the front face 72 of the interfacial seal 70 as shown in FIGS. 5 and 6, and deforming the same when in a latched position.

Figure 7:
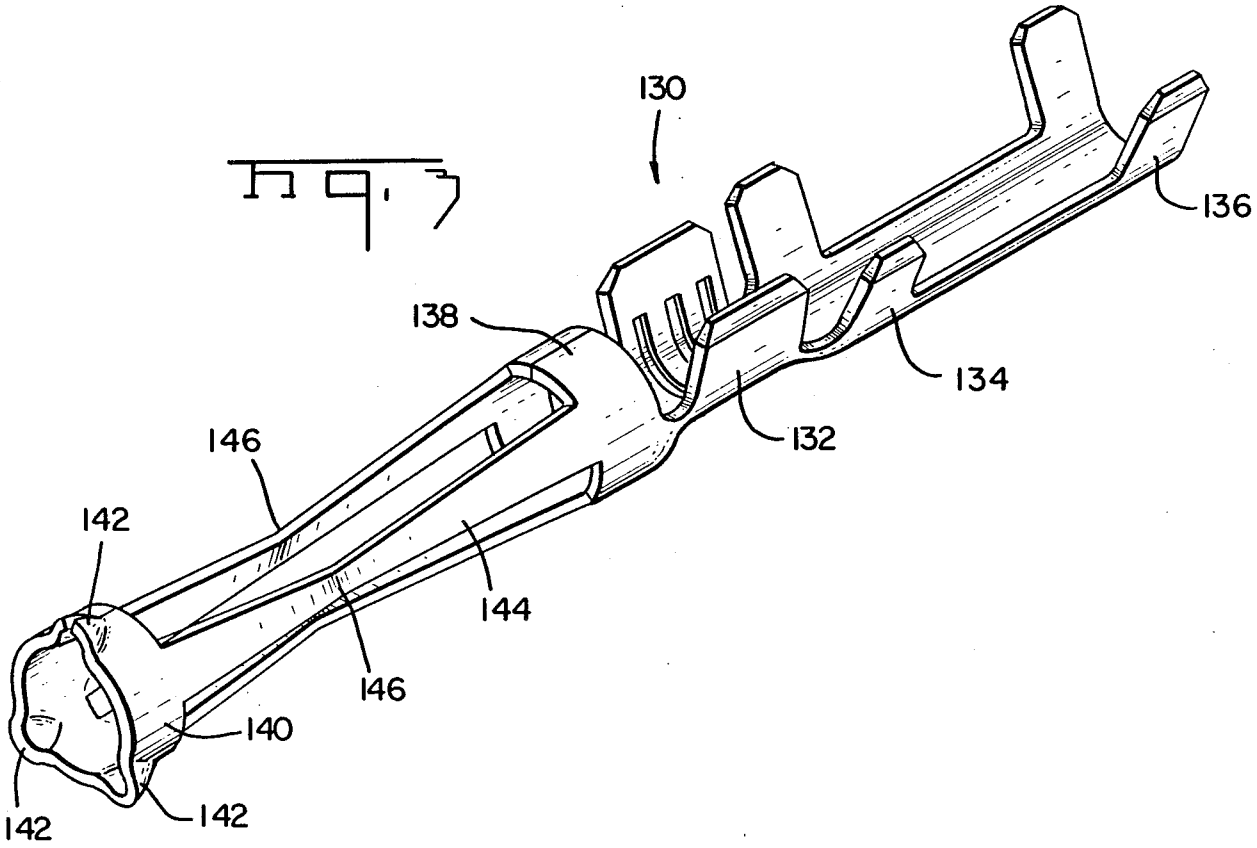
FIG. 7 is an isometric view showing the seal of the electrical connector in a retracted position for probing, while the electrical connector remains in a mated condition with the electrical receptacle.

The advantage to the instant invention relates to its diagnostic testing characteristics. As shown in FIG. 7, the seal member 80 and the seal cap 100 can be retracted from the connector which exposes the extended portions 136 of the terminals 130 for probing. Furthermore, the seal can be retracted and the terminals probed without effecting the electrical interconnection between the connector and the electrical receptacle 160. It is important in an electrical connection to maintain the electrical connection between the mating connectors because if a fault is detected in a system and the electrical connection is broken, it may have been a corroded connection between the pins and terminals of the matable connectors themselves which caused the failure. By disconnecting the connector from the electrical receptacle, the wiping action between the pins and terminals could be sufficient to partially remove the corrosion, such that reconnecting the connector and receptacle temporarily removes the discontinuity.

Furthermore, many times the equipment to which the connectors are interconnected only malfunction at certain operating conditions. Therefore, the malfunction is easiest to find if the equipment is run in a natural operating condition.

Figure 8:
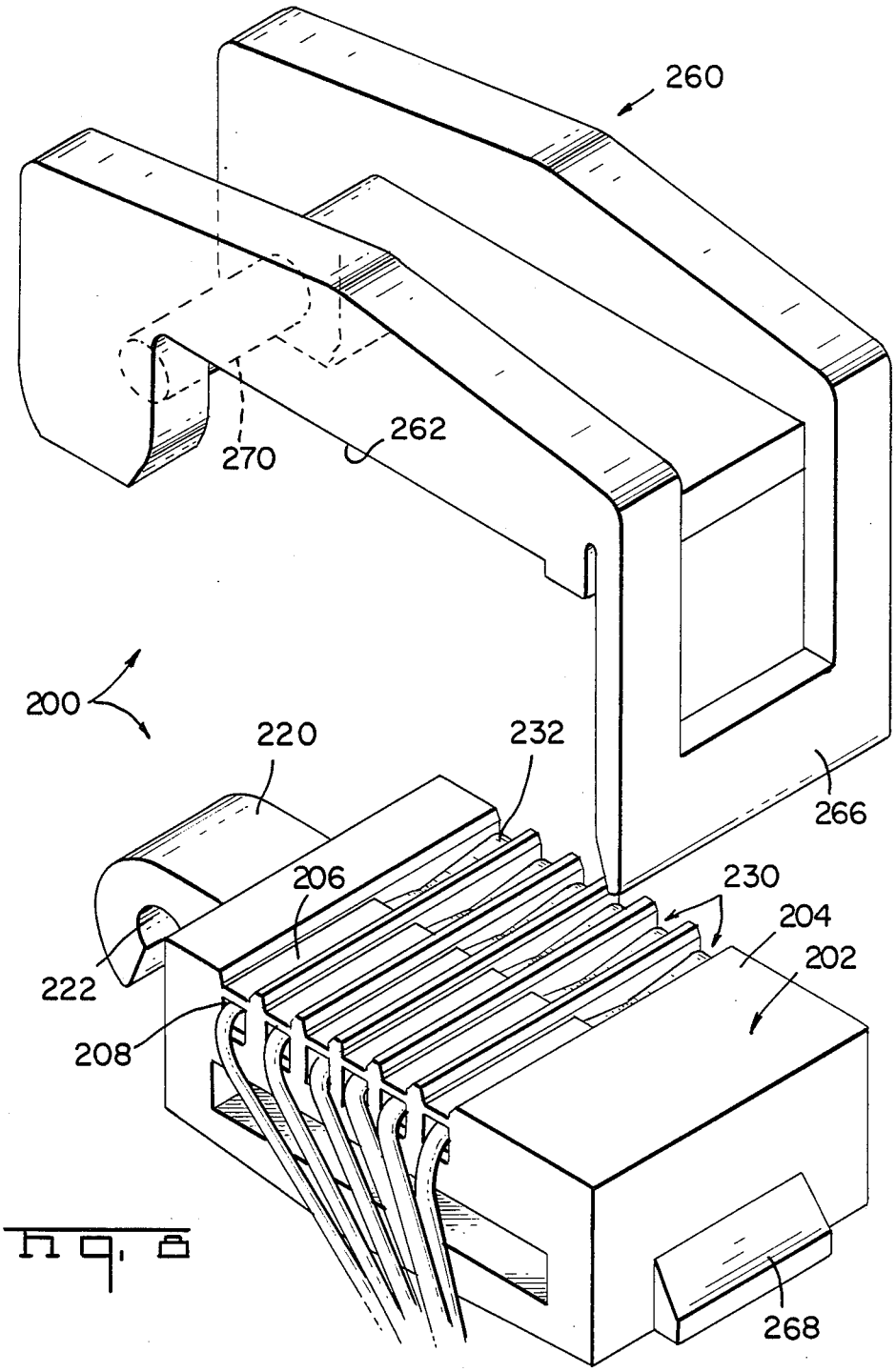
FIG. 8 is an isometric view of a probe which is used to probe the electrical terminals of the instant invention, when the seal is in the retracted position of FIG. 7.
Figure 9:
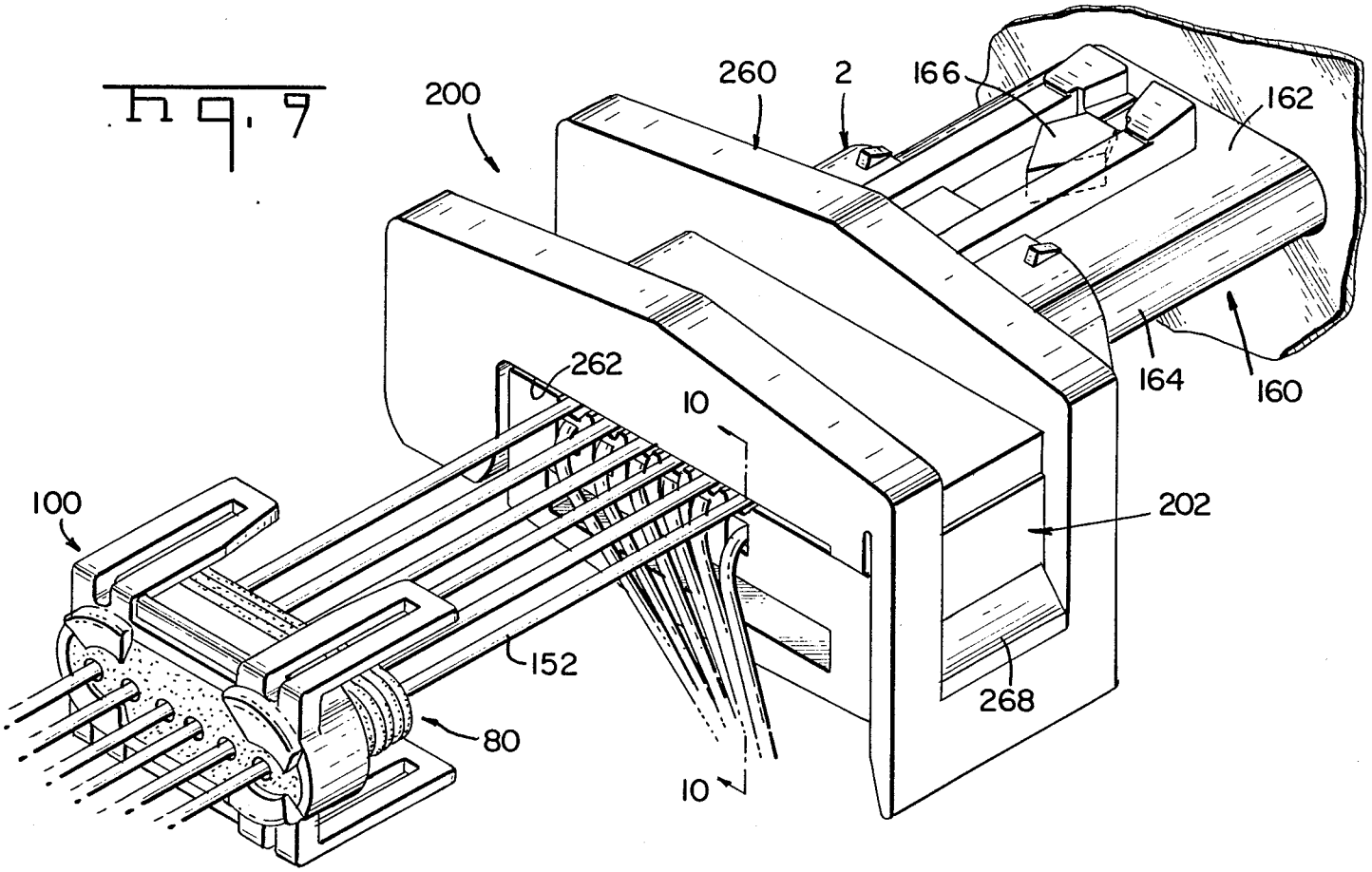
FIG. 9 is an isometric view showing the electrical connector in a mated condition with the electrical receptacle, with the seal of the electrical connector in a retracted position and with the probe in place to probe the terminals of the electrical connector.

FIG. 8 shows a probe which is alignable with the individual insulated conductors when the seal and seal cap 100 are in a retracted position, as shown in FIG. 7. The probe, as shown in FIG. 8, is described in more detail in pending application Ser. No. 053,458 entitled "Probe For A Sealed Connector", filed concurrently herein. The probe, as shown in FIG. 8, generally includes a body portion 202 having a plurality of apertures 208 situated side by side having a channel portion 206 aligned with and disposed above the apertures 208. The channel portions 206 only extend partially across the top surface 204 of the body member 202 which exposes a resilient contact portion 232 of a terminal 230 which resides in the apertures 208. In this manner, the probe body portion 202 can be placed beneath the plurality of individual insulated conductors 152, as shown in FIG. 7, each insulated conductor 152 residing in a single channel 206 of the probe body member 202. The body member 202 should be placed against the rear face 8 of the connector such that the resilient contact portion 232 is in a contacting relationship with the extended portion 136 of the terminal 130. The upper latch member 260 can then be placed over the individual insulated wires 150 and the dowel 270 of the upper latch member 260 can be placed within the semicircular portion 222 of the latch arm 220. With the upper latch member in place, the upper latch member 260 can be rotated relative to the body member 202 until the latch arm 266 latches with the latching detent 268 on the body member 204. The distance between the under surface 262 of the latching member 260 and the channel 206 causes an interference fit therebetween on the insulated conductor. It should also be noted that the under surface 262 backs up the extended contact portion 136 of the terminal so that when the upper latch member 260 is latched in place on the body member, the resilient contact portion 232 biases towards the floor 282 of the aperture 208. In this manner, a good electrical connection is made between the resilient contact portion 232 of the terminal and the extended contact portion 136 and a mechanical strain relief is created between the probe and the insulated conductors maintaining the probe in its position. Thus, the connector and header could be used in their normal environment without the fear of the probe becoming disconnected from the connector.

Figure 10:
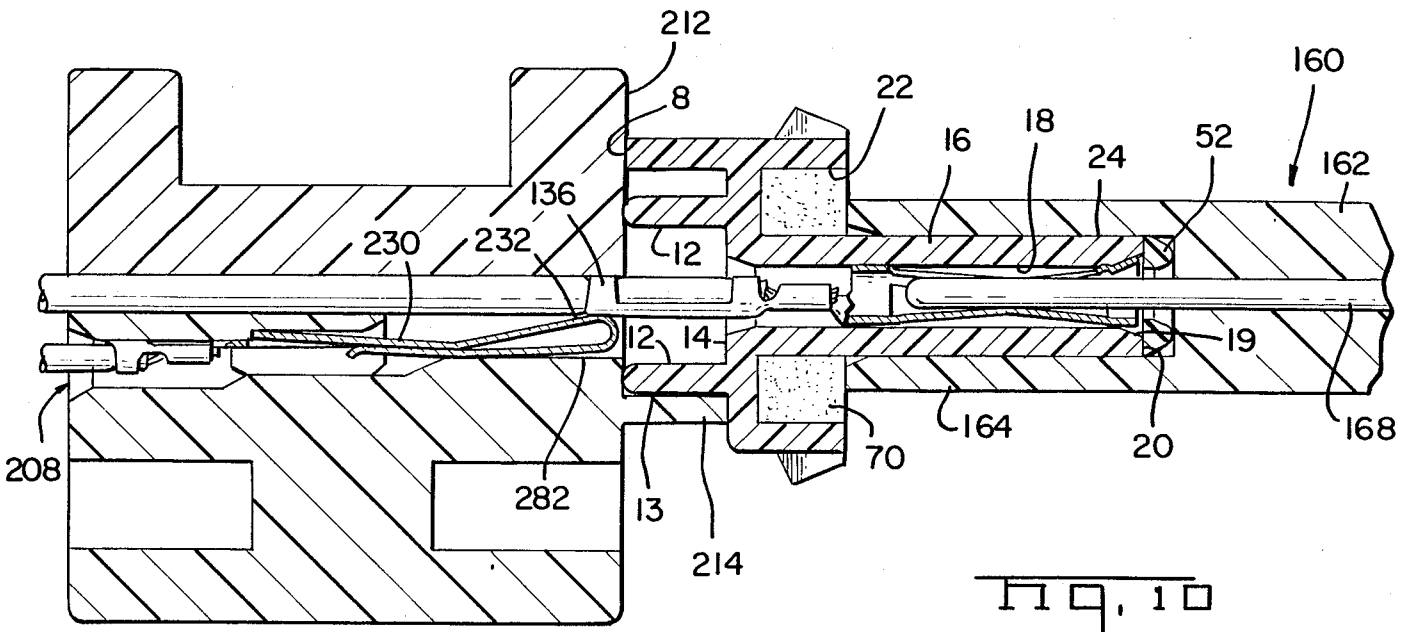
FIG. 10 is a cross-sectional view through lines 10—10 of FIG. 9.

It should also be noted that an open space is formed between the two edges 10 on the connector face 8 (FIG. 1), and a polarizing projection 214 extends from the front surface 212 of the probe and is profiled to fit in the recess when the front face 212 of the probe abuts the the face 8 of the connector housing 4, as shown in FIG. 10. The projection provides two functions, first the projection polarizes the probe with the connector housing, assuring that the probe is not placed on the connector incorrectly, and second the projection provides for a backup surface for the probe, preventing the probe from bending the terminal during installation of the probe, or from vibration during the test.

When the diagnostic test is complete, the probe is removed and the seal is again replaced, the forward portion of the seal 92 inserted within the cavity of the connector. Thus the instant invention relates to a sealed electrical connector which is diagnostically testable by removing the seal. The seal is removable and replacable for several cycles without degrading the integrity of the seal.

The instant invention was described by way of preferred embodiment only and should not be taken to limit the claims which follow.

What is claimed:

1. A sealed electrical connector comprising:

an insulative body having a front mating face, a rear face, and a plurality of apertures extending through the insulative body;

a plurality of electrical terminals positioned within said apertures, the terminals including a mateable contacting portion disposed adjacent to the front mating face, a conductor terminating section which is connectable to a conductor of an insulated wire, and an extended contact portion extending beyond the rear face of the insulative body;

means to retain the electrical terminals within the body; and a seal member positioned against the rear face which is retractable to a position to expose the extended portions of the terminals for probing.

2. The connector of claim 1 further comprising a shroud extending from the rear face rearwardly away from the front mating face, thereby defining a cavity.

3. The connector of claim 2 wherein an end of the shroud defines a probe mating face.

4. The connector of claim 3 wherein the seal is profiled as said cavity to be received therein with a first sealing means against an inner peripheral surface of the shroud.

5. The connector of claim 3 wherein the seal member includes apertures extending therethrough profiled to receive individual wires which are interconnected to the conductor terminating sections, the seal having second sealing means in circumferential contact with the wires.

6. An electrical connector for electrically interconnecting a plurality of electrical wires and being interconnectable with an electrical header, the connector comprising:

a central body portion comprised of an insulative material, the body portion including a front mating face profiled for interconnection to the header and a rear probe receiving area defined by a rear face and a cavity extending inwardly from said rear face thereby defining a rear wall at the termination of said cavity, the central body portion further comprising contact receiving apertures extending between the rear wall and the front face;

a plurality of terminals positioned within said apertures, each terminal including a contacting portion positioned adjacent the front mating face, an interconnection means for electrically interconnecting the terminals to conductors of the wires and an extended contact portion extending beyond the rear wall of the central body portion; and a seal means having a plurality of apertures therein in alignment with, and equal in number with, the contact receiving apertures within the central body portion, the apertures being profiled to interferingly surround the insulated wires, the seal means being profiled to seal the cavity of the central body portion.

7. The electrical connector of claim 6 wherein the extended contact portion includes a longitudinally extending portion which is integral with the interconnection means of the terminal, and arms extending transversely of the longitudinal section for wrapping around the insulation of the wires.

8. The electrical connector of claim 6 wherein the seal means is retractable away from the central body portion along the individual wires thereby exposing the extended portions of the contacts for probing.

9. The electrical connector of claim 8 wherein the seal includes a forward portion which is profiled for interferingly fitting within the cavity of the central body portion.

10. The electrical connector of claim 9 wherein the forward portion of the seal is profiled as said cavity with peripherally extending ribs therearound, the ribs creating the interference fit within the cavity.

11. The electrical connector of claim 6 further comprising means to retain the contacts within the apertures of the central body portion.

12. The electrical connector of claim 11 wherein the retention means comprises frusto conical surfaces at the ends of the apertures adjacent the front mating face.

13. The electrical connector of claim 12 wherein the terminals are only insertable into the apertures from the front mating face.

14. The electrical connector of claim 13 wherein the terminals include a flaired end for abutting the frusto conical surface of the contact receiving apertures.

15. The electrical connector of claim 14 wherein the retention means further comprises a plate means latchably connectable to the central body portion and over the front mating face, the plate portion having holes in alignment with the terminals, the holes having a diameter smaller than the ends of the terminals to retain the terminals within the apertures.

16. A sealed connector comprising:

a body portion having a rear face, a front mating face, and terminal receiving apertures extending to the front mating face and accessible from the rear face;

a plurality of terminals disposed in the apertures, the terminals including a front mating portion disposed adjacent to the front mating face and a conductor terminating portion, the terminal further comprising a portion extending beyond the rear mating face;

a sealing means having a first sealing portion at least partially disposed forward of the contact extended portion, profiled for sealing the interior of the body portion, and a rear sealing portion disposed rearward of the contact extended portion profiled for sealing engagement with an insulated wire connectable to said terminal, the sealing means being retractable from the body portion to expose the portion of the terminal which extends beyond the rear mating face.

17. A method of probing the electrical connection between an electrical connector and an electrical header while the connector and header are in a mating condition, the connector including a sealing means which is profiled to seal a window in the connector, the connector having terminals disposed adjacent to the windows within the electrical connector, the terminals being electrically connected to insulated wires which extend from the connector, the method including the steps of:

retracting the sealing means from the window to expose the terminals;

inserting the probe into the window in electrical contact with the terminals.

18. The method of claim 17 wherein the insertion of the probe includes the step of:

placing the probe over the wires with the wires in alignment with channel means in the probe;

placing a cap means in position onto the probe so as to secure the individual wires within the channels; and sliding the probe forwardly to effect electrical connection between electrical contacts within the probe and the electrical terminals within the connector.

19. A sealed and probeable electrical connector comprising an insulative housing having at least one contact therein, a portion of the contact being profiled for electrical connection with an external probe, the probeable portion of the contact being disposed adjacent to a window defined within the insulative housing, the connector further including sealing means, overlying said window, profiled to allow access to the contact probing portions.

20. The connector of claim 19 wherein the window defines a cavity within the housing, and a portion of the contact is disposed within the cavity.

21. The connector of claim 20 wherein the sealing means is retractable away from the window to allow access to the contact probing portion.

22. The connector of claim 21 wherein the housing includes an aperture extending therethrough with the contact disposed therein, the contact probing portion extending beyond the aperture and disposed within the cavity for probing.

* * * * *